US006556138B1

(12) United States Patent
Sliva et al.

(10) Patent No.: US 6,556,138 B1
(45) Date of Patent: Apr. 29, 2003

(54) SECURE STORAGE AND TRANSPORT CONTAINER FOR THE HANDLING OF CONTROLLED MATERIALS

(75) Inventors: Paul Sliva, W. Richland, WA (US); Kurt A Stahl, Lake Oswego, OR (US); Kevin L Simmons, Kennewick, WA (US); Norman C Anheier, Richland, WA (US); Norman R Gordon, Kennewick, WA (US); Walter R Park, Benton City, WA (US)

(73) Assignee: Ziro Limit Composite, Inc., West Richland, WA (US)

( * ) Notice: Subject to any disclaimer, the term of this patent is extended or adjusted under 35 U.S.C. 154(b) by 0 days.

(21) Appl. No.: 09/225,843

(22) Filed: Dec. 31, 1998

(51) Int. Cl.[7] ..... G08B 13/14

(52) U.S. Cl. ..... 340/568.1; 340/545.6; 340/550

(58) Field of Search ..... 340/568.1, 570, 340/572.1, 572.8, 555, 550, 545.6, 825.34, 825.49, 539; 109/41, 42; 700/115; 705/28

(56) References Cited

U.S. PATENT DOCUMENTS 4,538,527 A * 9/1985 Kitchen ..... 340/550 X
5,001,425 A * 3/1991 Beling et al. ..... 340/568.1 X
5,539,379 A * 7/1996 Mac Pherson ..... 340/550
5,576,621 A * 11/1996 Clements ..... 340/568.1 X
5,721,531 A * 2/1998 Garver et al. ..... 340/570 X
5,796,335 A * 8/1998 Droege et al. ..... 340/550
5,822,714 A * 10/1998 Cato ..... 702/108
5,844,483 A * 12/1998 Boley ..... 340/572.1 X
5,977,875 A * 11/1999 Lin et al. ..... 340/570

FOREIGN PATENT DOCUMENTS

GB 2245 738 * 1/1992 ..... 340/550

* cited by examiner

*Primary Examiner*—Thomas Mullen
(74) *Attorney, Agent, or Firm*—Douglas E. McKinley, Jr.

(57) ABSTRACT

The invention is a secure container for the transport and storage of materials that can alert the user as to the location and condition of materials, as well as container status. This provides cargo and access information that is critical in high-value or controlled shipments. The container uses a wound fiber-optic layer embedded in a covering. A transmitted light signal is sent through the fiber-optic layer to a receiver. Any change in the light signal causes an alarm or indication. The container also gives real time read outs, remotely or locally, as to the conditions of the contents and the container itself.

10 Claims, 5 Drawing Sheets

SECURE STORAGE AND TRANSPORT CONTAINER FOR THE HANDLING OF CONTROLLED MATERIALS

FIELD OF INVENTION

The present invention relates generally to a secure container that can be used for the transport and storage of materials whose location and condition needs to be continuously monitored or recorded.

BACKGROUND OF THE INVENTION

In today's world of commerce, materials are constantly moving interstate and internationally. Many of these materials need to be either controlled or monitored. It is useful to those that are burdened with the responsibility to control or monitor these shipments to have real-time information about the status and location of the materials, and the containers that house those materials. For example, it is useful to know the location, the condition, and if the cargo was accessed or tampered with by unauthorized parties. These materials and cargo can include things such as: high value items, jewels and cash; weapons, strategic or conventional; hazardous materials; medical or biological related; and materials that are time or condition sensitive in nature. A variety of means are now employed to attempt this level of control and monitoring.

The oldest of the means is to place the cargo under lock and key at the shipping point, and then later unlock the cargo at the point of delivery. This method has limited commercial success as it does not provide information as to either the condition of the cargo during shipment, or if the cargo was taken on a detour. Nor is any indication given if a duplicate key was used to gain access to the cargo during transit, and then reseal the shipping container to conceal that access.

A global positioning system (G.P.S.) is a partial solution for this problem. G.P.S. has been used for things like automobiles and other high value items. However, this does not provide information on access or condition during shipment. For example, the G.P.S. could be tracking a tow truck moving the automobile after an accident and the G.P.S. would simply provide information on its continuously changing location.

Current burglar alarm technology utilizes continuous conductive strips on windows and doors. However, these strips, like any conductive strips, may be jumpered around, and therefore defeated.

In view of these difficulties, it would be useful to those charged with the responsibility for the shipment of critical cargo to know the cargo's condition, if it was accessed or tampered with, as well as its location continuously. This is possible with the instant invention.

SUMMARY OF THE INVENTION

The instant invention simultaneously provides, location, access, and condition information about the cargo and containers of critical shipments. The instant invention is a secure container for the transport and storage of materials, whose location and condition needs to be monitored either real time or near real time. The container employs a wound fiber-optic layer embedded in a covering. An IR transmitter sends light through the fiber-optic layer to a receiver. Any change in the light signal causes an alarm or indication, either locally or at a pre-designated location. The container also gives real-time read outs, remotely or locally, as to the conditions of the contents and the container itself.

The subject matter of the present invention is particularly pointed out and distinctly claimed in the concluding portion of the specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENTS

Figure 1:
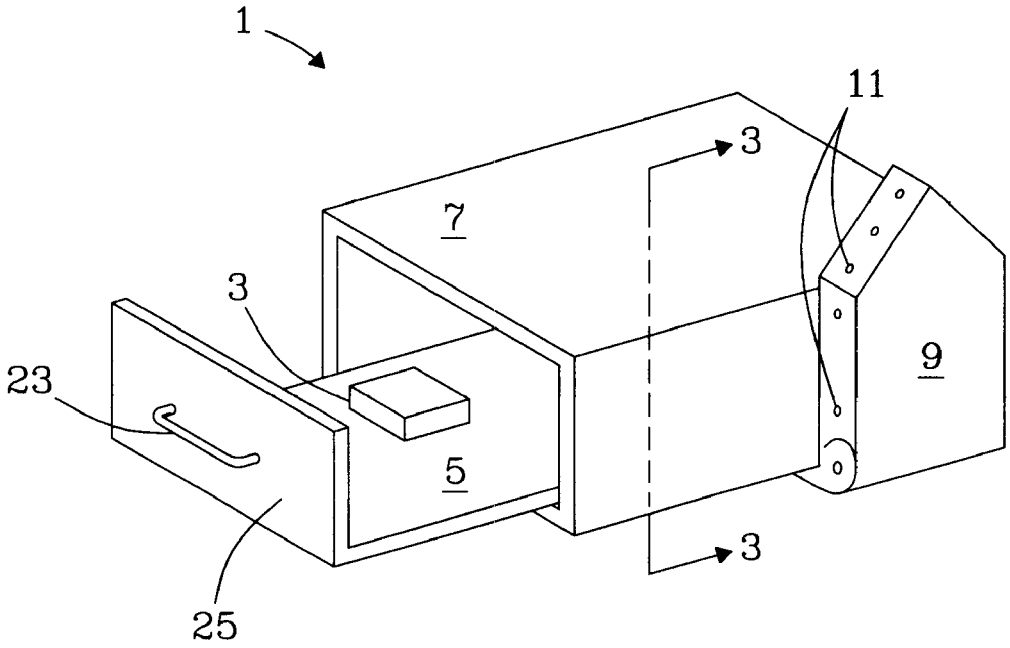
FIG. 1 is an isometric view of the outer shell of the drawer embodiment of the instant invention with the drawer extended and covering removed.
Figure 2:
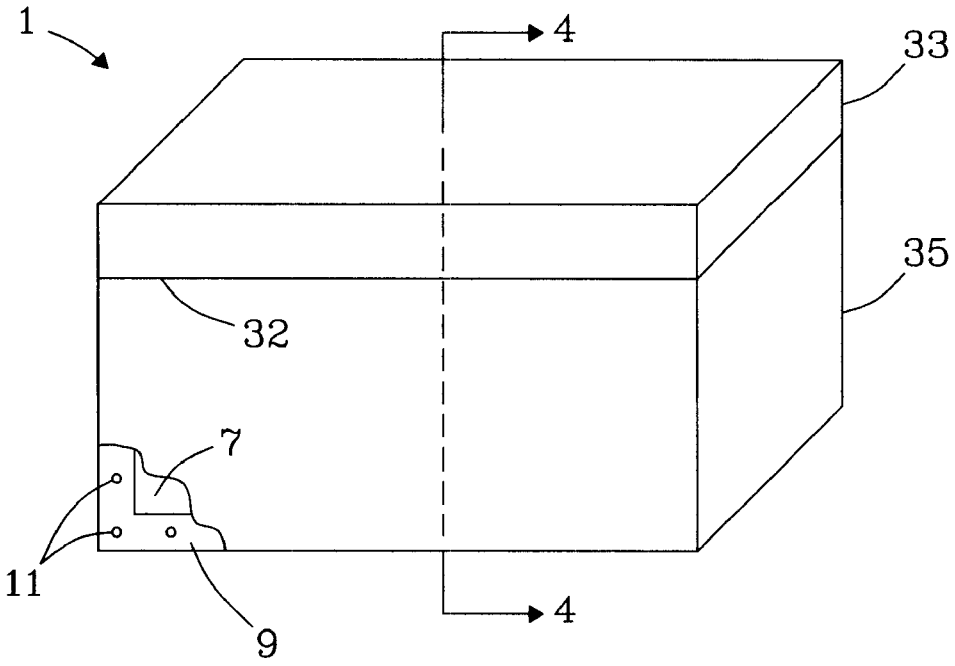
FIG. 2 is an isometric view of the outer shell of the cargo embodiment of the instant invention illustrating the covering and the placement of the fiber optic cable.

Referring to FIG. 1 and to FIG. 2 the instant invention is a secure storage and transport container 1 for the handling of controlled materials 3 within a storage cavity 5.

Figure 3:
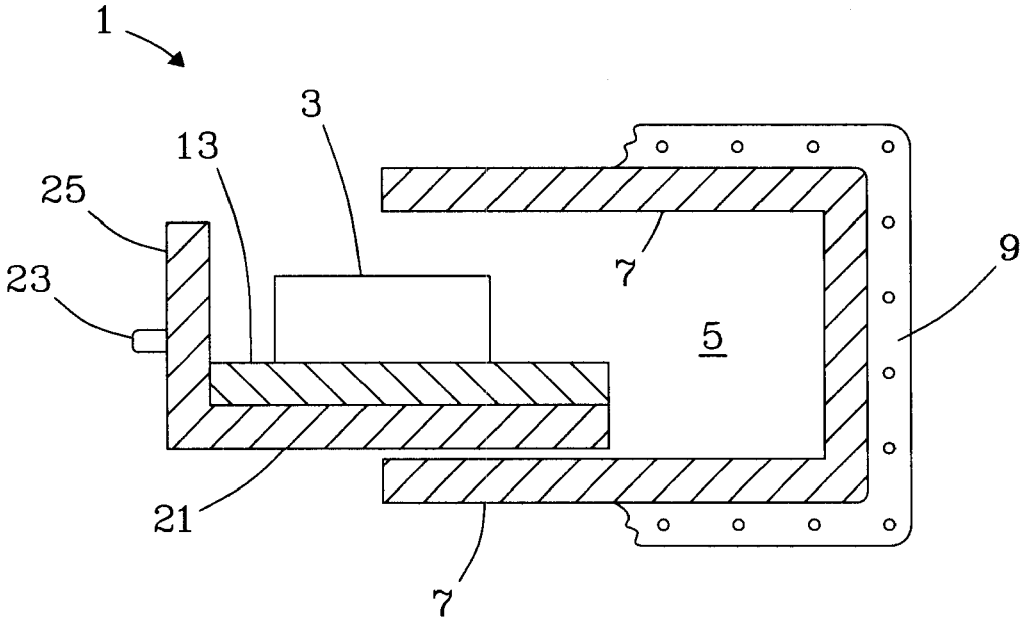
FIG. 3 is a cross-section along the lines 3—3 of FIG. 1.
Figure 4:
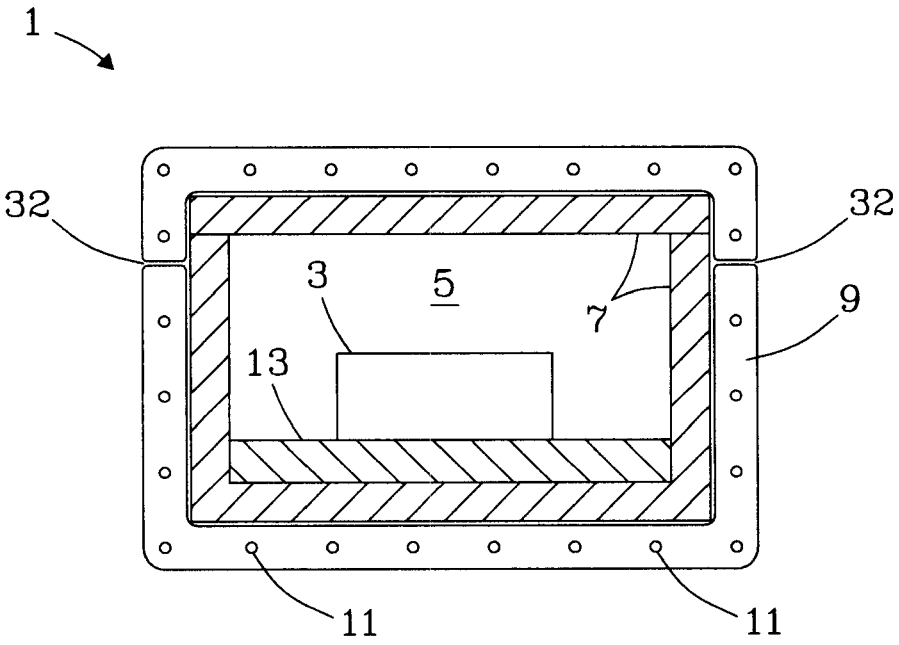
FIG. 4 is a cross-section along the lines 4—4 of FIG. 2.

Now referring to FIG. 3 and to FIG. 4, there are no limitations on the size of the outer shell 7, or the storage cavity 5, which is enclosed by a covering 9 that is a supportive structure which supports, and holds in place, a continuous optical fiber 11 that is connected to an electronics package 13. The instant invention readily lends itself to containers from the size of match boxes up to Conex and Sealand containers.

Now referring to FIG. 4, the cargo embodiment, is for the outer shell 7 to be the size of typical hand-held luggage for the transport and control of smaller items or materials 3 within a storage cavity 5. Another cargo embodiment is for the outer shell 7 to be large enough for the secure container 1 to be accessed, from above or the side, via a man hole or doorway (not shown).

Now referring to FIG. 3, yet another embodiment utilizes a drawer for ease of handling the materials 3 and location of the electronics package 13. Still another embodiment can be used to store and transport gaseous or liquid materials utilizing the outer shell as the actual containment of the materials (not shown). Materials, items, stored items, contents, controlled inventory, and packages will be used interchangeably to indicate the item or thing that is stored or transported within the instant invention.

PHYSICAL STRUCTURE

Figure 5:
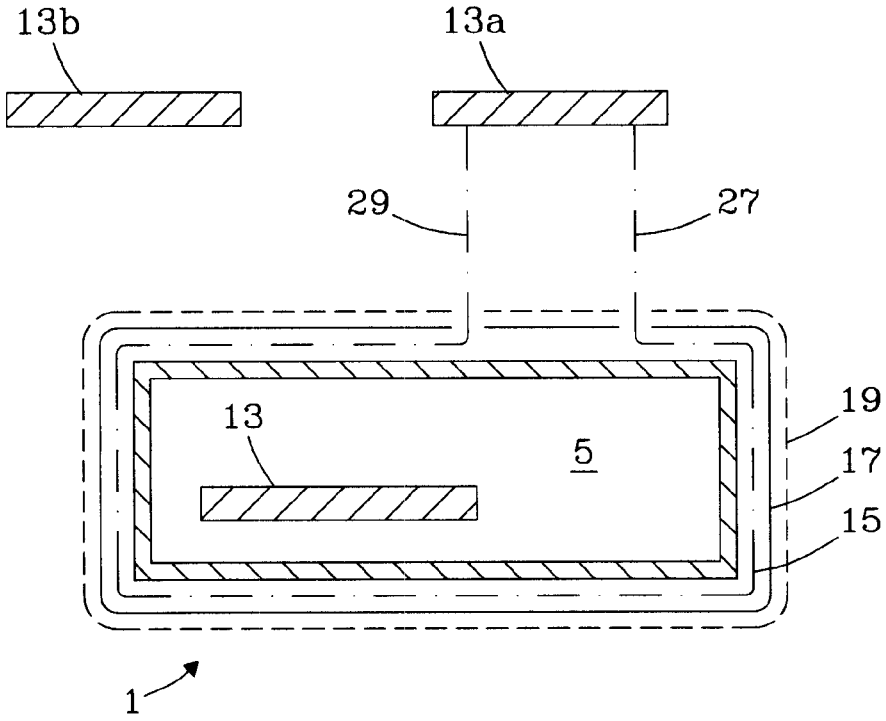
FIG. 5 is a schematic representation of the instant invention illustrating external connection to an electronics package.

Now referring to FIG. 5 the basic physical structure of the instant invention comprises an outer shell 7 having a covering 9 which typically has an optical fiber covering 15, a non-active fiber covering 17, and a woven fiber mat covering 19. The physical structure of the instant invention 1 has an electronics package 13 that is contained within the outer shell 7. The coverings 15,17,19 are wrapped in a continuous manner around on the outer shell 7. It should be noted that the fiber's ability to be woven is an advantage, however, it must also be kept in mind that bending of the fiber reduces the light reaching the detector.

Referring again to FIG. 3 within the outer shell 7 can be a drawer 21 that contains the materials 3 that are to be transported or stored. For ease of removal, a handle 23 is placed on front end 25 of the drawer 21.

Referring to FIG. 5 it is contemplated that one skilled in the art can combine the non-active fiber coating 17 and the woven fiber mat covering 19 into a single outer layer as illustrated in FIG. 3. It is also contemplated that an uncovered optical fiber cable can be woven around the outer shell then covered in material that is capable of being cast around the optical fiber cable. It is well known in the art to be able to cast materials such as polymers, fiberglass, concrete, etc around cables.

CONNECTION TO ELECTRONICS PACKAGE

Figure 6:
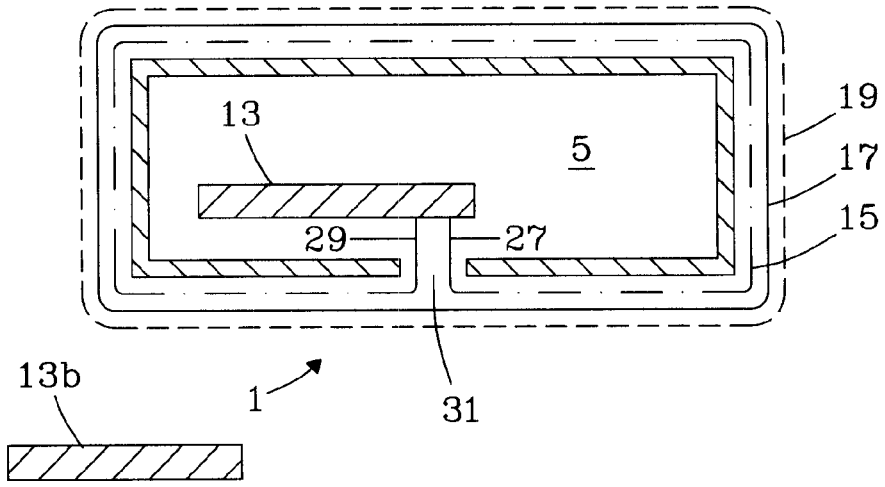
FIG. 6 is a schematic representation of the instant invention illustrating internal connection to an electronics package.

Now referring to FIG. 5 and FIG. 6 the electronics package 13, 13*a*, 13*b*, can be connected to the optical fiber covering 15 in three principle ways: (I) externally as illustrated in FIG. 5; (ii) internally as illustrated in FIG. 6 which is used in the majority of the applications; or (iii) remotely using, for example, electromagnetic (EM) or infra-red (IR) radiation.

IR radiation is invisible to the naked eye and is readily applicable to commercially available fibers. Visual spectrum light can also be used, as well as having commercially available fibers or use with visible light. The desired spectrum of radiation that is used is typically created by fixed spectrum diode (not shown) that is well known in the art.

If radiation is used as the means of connection the electronics package 13 is typically located within the outer shell 7 for security and ease of handling reasons, as illustrated in FIG. 6. As illustrated in FIG. 6 the electronics package 13 would be a transmitter, and another electronic package 13*b* would be the receiver. This embodiment would be particularly valuable in situations where loss of the container itself is possible. The remote electronic package 13*b* would record, process, and provide the necessary indications to the user.

External Connection

Referring again to FIG. 5 the first connecting lead 27 and the second connecting lead 29 are passed through the non-active fiber 17 covering and the woven fiber mat covering 19 to an external electronics package 13*a*. This embodiment would be best suited for storage applications. Typically, with more than one container in a storage area.

Internal Connection

Referring again to FIG. 6 the first connecting lead 27 and the second connecting lead 29 are passed through a penetration 31 in the outer shell 7 to the electronics package 13. The internal connecting means lends itself greater ability to transport or conceal the secure nature of the container 1. When connected internally the secure container can collect data about any break of integrity or it can transmit (or store) data describing the conditions of the contents or cargo 3.

Remote Connection

Referring again to FIG. 5, it is well known in the art for the internal electronics package 13 to be able to communicate with a non-physically connected external electronics package 13*b* (or other indicating or receiving systems—not shown) via electro-magnetic or infra-red radiation. For example, information concerning the location of the cargo may be communicated by utilizing a GPS system in electronics package 13. The remote connecting means lends itself greater ability to transport or conceal. With the use of satellites the distances for use is greatly increased.

INDICATION FUNCTIONS OF THE ELECTRONICS PACKAGE

There are four principle functions of electronics package 13: tamper indication; location indication relative to pre-set boundaries; condition and status data recording and/or transmitting; and notice initiation for a pre-determined set of conditions or occurrences. Conditions considered include, but are not limited to, moisture, light, vibration, chemicals, radiation, movement, or any other detectable quantity.

Each function provides real-time indication of the desired functional feature on the instant invention 1. The indication provided can be all four types, or alternatively one of each or any combination thereof. It is not germane to the instant invention if the indication produced by the instant invention is used to initiate action or merely to give passive indication. Nor is it germane whether the indications are local or remote from the secure container 1.

An advantage of the instant invention is that the indication capabilities of the instant invention can be disguised or hidden to an observer.

For each embodiment the electronics package 13 can perform a plurality of functions. For example: indication when the secure container moves across a specified boundary, such indication can also either be internal or external; inventory control of the materials; real-time location of the cargo 3; or the relationship of the secure container 1 to specified boundaries can be monitored.

Figure 7:
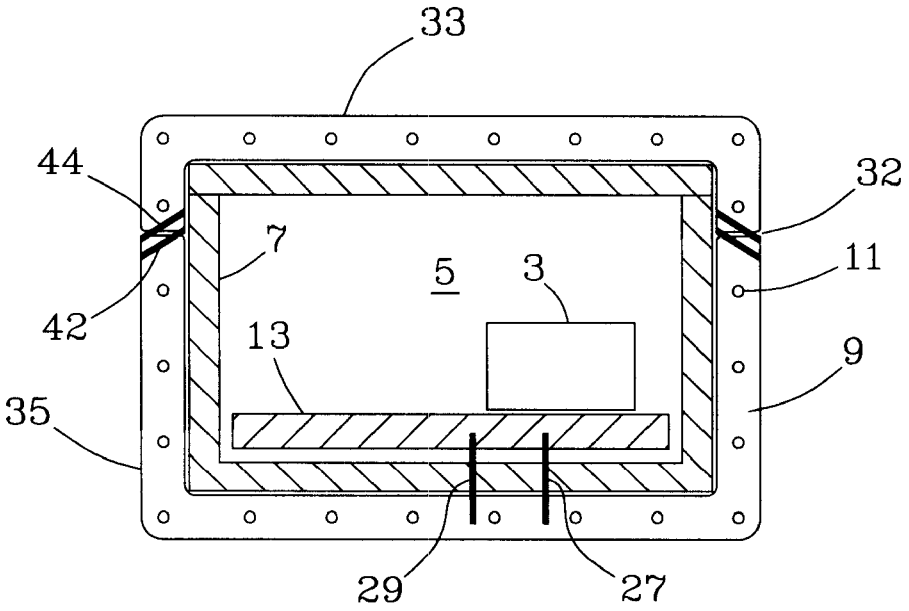
FIG. 7 is a cross section along lines 4—4 illustrating the lid in the closed position.
Figure 8:
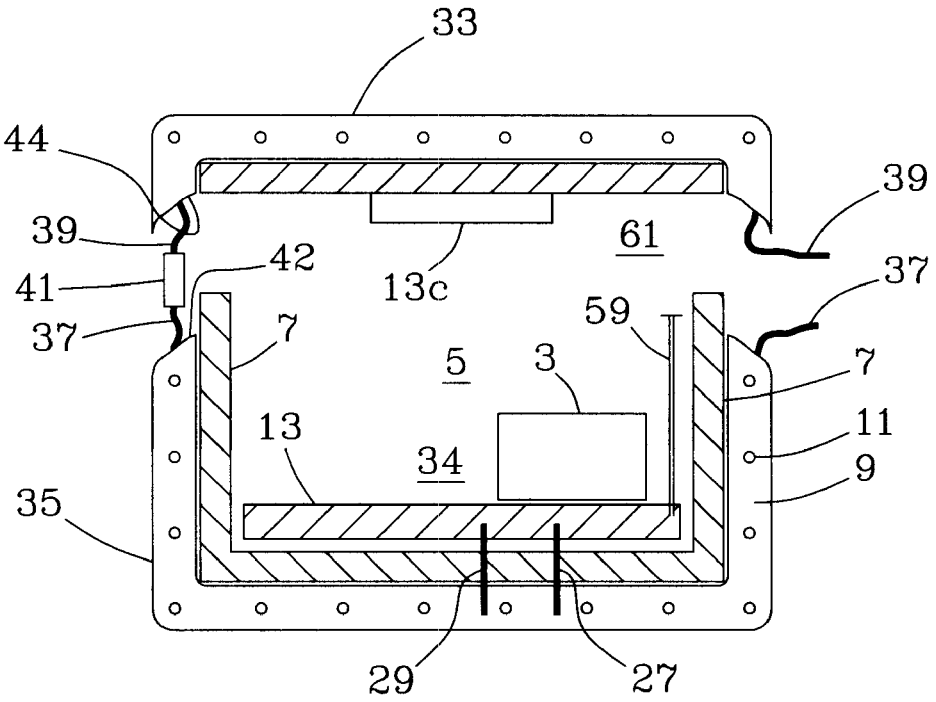
FIG. 8 is a cross section along lines 4—4 illustrating the lid in the open position.

Now referring to FIG. 7 and FIG. 8 the electronics package 13 can be placed in the bottom of the secure container 1 with the cargo 3 placed on or near the electronics package 13. It should be noted that the electronics package 13 can be placed anywhere within the secure container 1, i.e. the bottom area 34, in the lid 33, or in the walls of the outer shell 7. To enable access to the secure container 1, for the storage and removal of cargo 3, a seam 32 is used to separate the container body 35 from the lid 33. It is within the contemplation of the invention that the lid 33 may be hinged upon one side (not shown). When the lid 33 is removed the first lead 37 and the second lead 39 are separated, thereby breaking the continuity of the optical fiber. For ease of reuse a coupling 41 is typically used. The seam 32 consists of a lower sealing surface 42 and an upper sealing surface 44.

Figure 9:
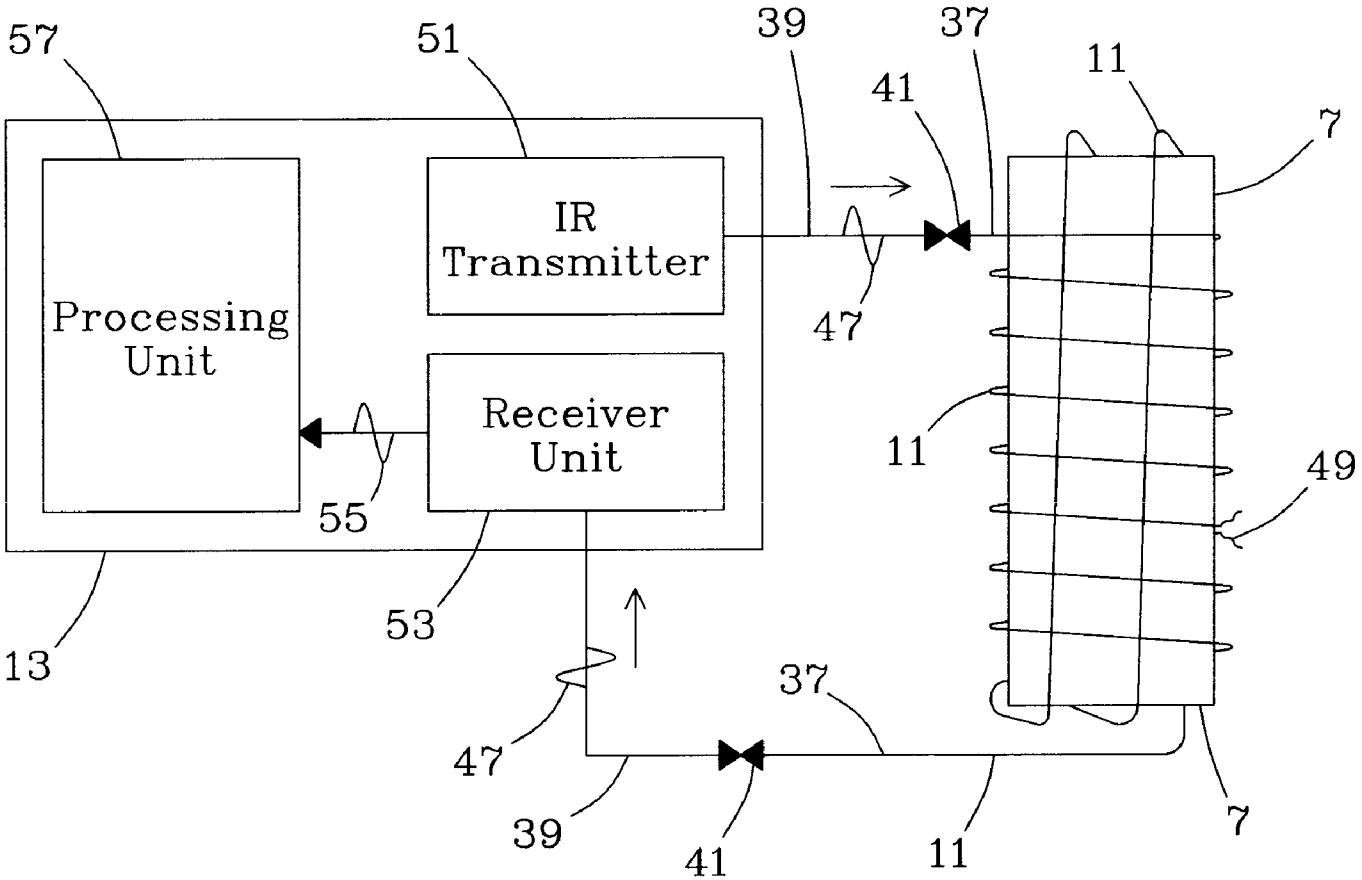
FIG. 9 is a schematic representation of the IR signal path from the IR transmitter to the IR receiver and the initiation of the event

Now referring to FIG. 9 either one of two occurrences can interrupt an IR signal 47 in the optical fiber 11. The first is for a coupling 41 to be opened, and the second is for a break 49 or alteration 49 to occur in the optical fiber 11. Within the electronics package 13, an infra-red transmitter 51 passes an IR signal 47 through the optical fiber 11 to an IR receiver unit 53. Such that when the optical fiber 11 is breached 49 (or changed 49) there is a change of the IR light signal 47 at the receiver 53 unit.

Upon sensing a change in the IR signal 47, the receiver 53 will send an event signal 55 to a processing unit 57 that records the event signal 55 and/or can be used to trigger other events. Whether the event is merely recorded or used to trigger other events depends upon the needs to be fulfilled by the particular embodiment of the instant invention.

Still referring to FIG. 9 the optical fiber 11 should be spaced close enough together to make breaking or alteration of the optical fiber 11 necessary to be able to access the cargo 3 other than through opening the lid 33. Alternatively, the covering 9 should be secure enough to necessitate the disruption of the optical fiber 11 should penetration of the secure container 1 be attempted.

Another operational consideration is that the electronics package can be fitted with a connection to a PC or lap-top computer for analysis of the data.

OPERATION OF THE DRAWER EMBODIMENT

Referring again to FIG. 1 the drawer embodiment of the instant invention is a secure container that is typically luggage size or smaller. This embodiment is typically used to transport items/materials that are either valuable or hazardous, or for any reason, its location and access need to be controlled.

RF TAG SYSTEM

Now referring again to FIG. 8, a commercially attractive embodiment is the RF-tag system. In this embodiment 1 of the instant invention an antenna 59 is embedded near the container opening 61, which antenna reads all items 3 having an RF tag that move across the system boundary. An "RF tag" refers to any item 3 that emits an RF signal that can be detected by the electronics package 13. The electronics package can store and/or transmit the information.

OPERATION OF THE SEALED CONTAINER EMBODIMENT

When said optical continuous strand is penetrated said indicator system gives an indication to an observer at the desired location.

STRUCTURAL AND PHYSICAL CONSIDERATIONS

It is well known to one skilled in the art that the construction materials used to fabricate the particular embodiment can vary according to the instant invention end use. For example, the materials (including the electronics package) can be radiation insensitive, microwave hardened, heat resistant, acid resistant, impact resistant. If reactive chemicals or elements are shipped or stored in the instant invention then due consideration would have to be given in construction material selection.

The use of fiber optics as the sensing circuit of the instant inventions adds certain advantages. For example, it can't be defeated by electromagnetic radiation. Nor is it possible to use cable jumpers as with conventional electrical circuits.

An advantage of the instant invention is that the indication capabilities of the instant invention can be disguised or hidden to an observer.

REUSE OF CONTAINERS

Inherent in the secure nature of the container that is the instant invention is the need to be able to place the contents in and out of the container and still preserve the usefulness of the container. Couplings (mechanical, electrical, magnetic, etc.) of the optical fiber can be used at or near the place where either the drawer(s) 25 or lids 33 are removed from the outer shell. An internally connected electronics package is typically set with a timer that will give the user time to replace the lid or the drawer.

The use of reusable optical fiber couplings is well known in the art.

MATERIALS TO BE TRANSPORTED OR STORED

Any material that is capable of being contained can be transported or stored in the instant invention. The drawer embodiment lends itself to use with packages that are to be frequently handled by personnel or loading equipment. The sealed container embodiment lends itself to the seal on shipment—open on arrival type shipments.

OTHER EMBODIMENTS POSSIBLE

While several embodiments of the present invention have been shown and described, it will be apparent to those skilled in the art that many changes and modifications may be made without departing from the invention in its broader aspects.

We claim:

1. A secure container for the shipment of cargo comprising:

a. an outer shell having a storage cavity defined by the inside volume of the outer shell into which is placed said cargo;

b. an electronics package, providing continuous indication of said cargo status and location;

c. a covering having a continuous optical fiber within a supporting structure;

wherein when said continuous optical fiber is tampered with an indication of said tampering is given.

2. The secure container in claim 1 wherein the outer shell consists of a container body and a lid.

3. The secure container in claim 2 wherein said electronics package is in the lid.

4. The secure container in claim 2 wherein said electronics package is in the bottom area of said outer shell.

5. The secure container in claim 1 wherein said electronics package is exterior to said outer shell.

6. The secure container in claim 1 wherein said outer shell is accessible via a drawer.

7. The secure container in claim 1 wherein said electronic package transmits said indications to a remote indicator.

8. The secure container in claim 1 wherein location information is provided via a GPS location system.

9. A secure container for the shipment of cargo comprising:

an outer shell having a container body, lid, and storage cavity defined by the inside volume of the outer shell into which is placed said cargo;

an electronics package, providing continuous indication of said cargo status and location, said electronics package having an antenna placed near the opening of said container, wherein when said cargo moves across a container boundary a signal is generated in said electronics package, said signal indicating movement of said cargo into or out of said container.

10. The secure container in claim 9 wherein said signal is generated in an RF tag system.

* * * * *